United States Patent [19]

Johnstone

[11] 4,392,306

[45] Jul. 12, 1983

[54] LETTERGUIDE

[76] Inventor: George A. Johnstone, P.O. Box 6, Grantham, Q.4347, Australia

[21] Appl. No.: 268,582

[22] Filed: May 29, 1981

[30] Foreign Application Priority Data

Jun. 9, 1980 [AU] Australia ..... PE03953

[51] Int. Cl.[3] ..... B43L 13/20

[52] U.S. Cl. ..... 33/174 B

[58] Field of Search ..... 33/174 B, 174 G

[56] References Cited

U.S. PATENT DOCUMENTS 2,005,255 6/1935 Oslund ..... 33/174 B 3,716,921 2/1973 Vicent ..... 33/174 B

*Primary Examiner*—Willis Little

*Attorney, Agent, or Firm*—Schmidt, Johnson, Hovey & Williams

[57] ABSTRACT

A letter forming stencil for use in signwriting or the like comprises a substantially rectangular plate having two apertures formed therethrough and having a separate corner forming piece or pieces, the stencil in use being placed on the surface upon which it is desired to form letters and the outline of the letter being traced thereon, the length of various lines comprising the letter being judged against indication means and spaced around the perimeter of the plate and the corners of the letter being formed with the aid of corner forming pieces. The corner forming pieces may comprise any one of (a) quadrants pivotably located adjacent each corner of the plate, and being pivotable so as to extend over the perimeter of the plate, (b) a T shaped piece able to be pivotably located centrally on the plate, the arms of the T shaped piece extending over the perimeter of two corners of the plate, (c) a separate piece having a number of corners formed thereon or (d) alternate round or square shaped corners formed in the plate, the plate being moved in order to position the corners as desired on the letter outline.

8 Claims, 7 Drawing Figures

Figure 1:
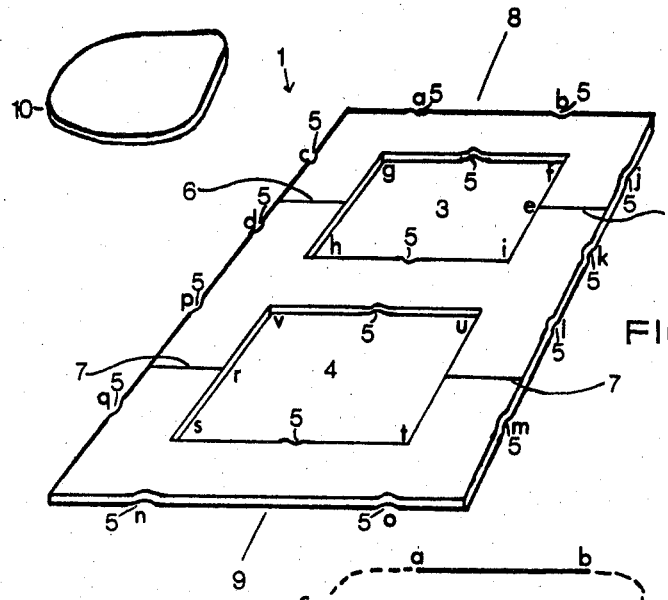

8
1
10
a 5
b 5
5
c
6
5
d
g
5
f
3
e
5
6
h
5
i
j
5
k
5
p 5
v
5
u
l
5

7
5
q
r
4
7
s
5
t
m
5
5 n
5 o
9 a
b
c
g
f
j
e
k
d
h
i
v
u
l
p
r q
s
t
m
n
o 20
22
21
21
22

20

LETTERGUIDE

The present invention relates to drawing stencils and in particular to lettering stencils for use in signwirting or the like. Such stencils are of the type used to form numerals or letters of the alphabet and which allow a temporary outline of the letter or numeral to be made prior to the application of ink, paint or the like, or alternatively allow direct application of the ink or paint to form a permanent letter or numeral image. Known forms of such stencils often comprise a thin stencil sheet or plate of material such as steel, plastic or other suitable substance, and in which are formed cutout sections in the shape of letters, numbers, or other required symbols. In use the stencil sheet or plate is placed on the surface on which it is desired to form a letter, and a pen or other suitable writing instrument is used to trace either a temporary or permanent outline of the letter, with the assistance of the said cutout section. The stencil sheet may then be removed, leaving an image of the letter of the surface. It can be seen therefore that there is required one or each said cutout sections for each letter of the alphabet and that the size of the stencil sheet must be relatively large, especially if upper case and lower case letters, and numerals are required, and more especially if the letters and numerals are of a large size as might be required for commercial applications. It is also known to subdivide such stencil sheets into smaller sheets containing groups of one or two letters, in order to provide stencil sheets of more manageable sizes.

Further known forms of such stencils comprise rigid figures in the shape of letters or numerals or other required symbols, which are placed on the surface on which it is desired to form a letter, and their outline is then traced with a writing instrument, so that when the said rigid figure is removed an image of the letter remains on the surface. Such stencils require one individual rigid figure for each letter, numeral or symbol.

It can be seen that all known forms of lettering stencils comprise either a relatively large stencil sheet, or a large number of small stencil sheets or rigid figures.

It is therefore an object of the present invention to provide a lettering stencil of a compact size which is easy to use and overcomes the herein stated disadvantages of known forms of lettering stencils.

Accordingly the invention comprises a stencil comprising a substantially rectangular plate consisting of two regions of substantially equal surface area, each of said regions having an aperture located substantially centrally within said region and said plate being provided with indication means proximal to its perimeter, the said plate having an axis of symmetry coincidental with its longitudinal axis and a further axis of symmetry coincidental with its transverse axis.

Figure 1A:
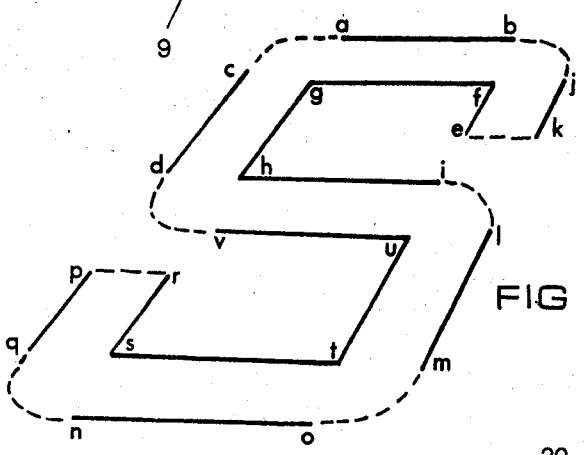
Figure 2:
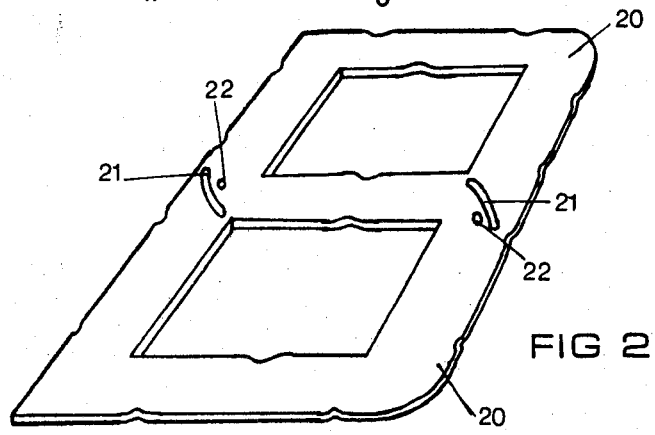
Figure 3:
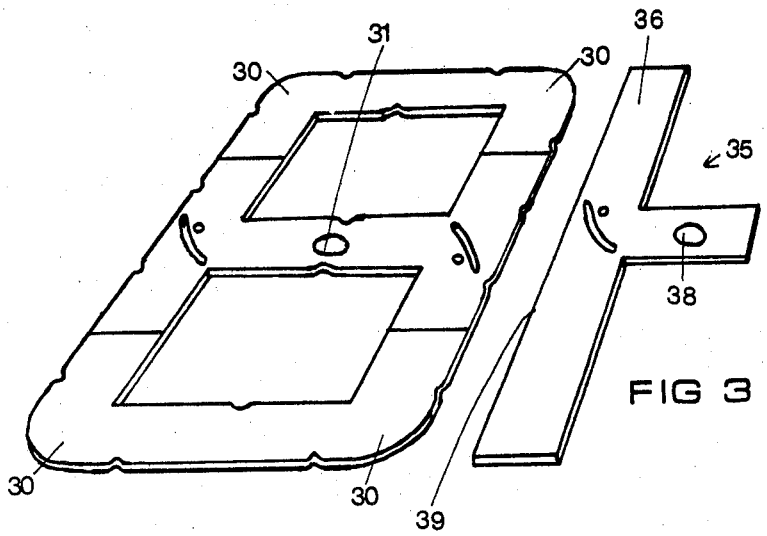
Figure 3A:
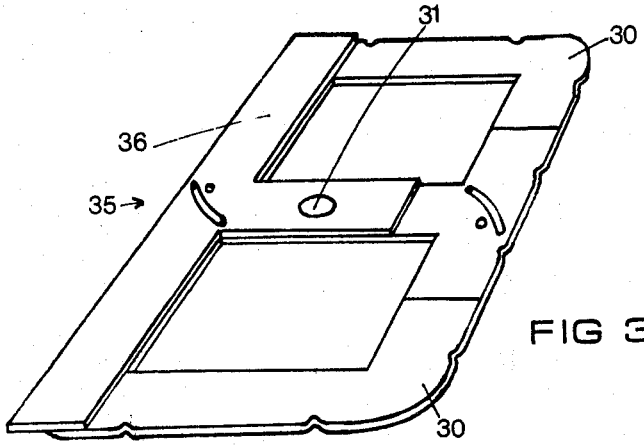
Figure 4:
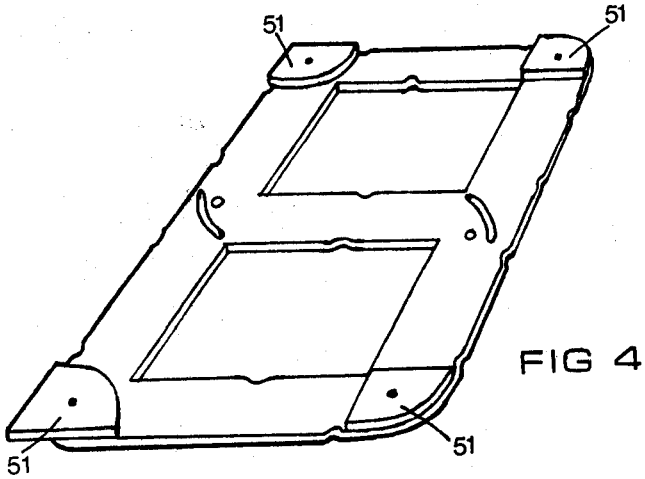
Figure 5:
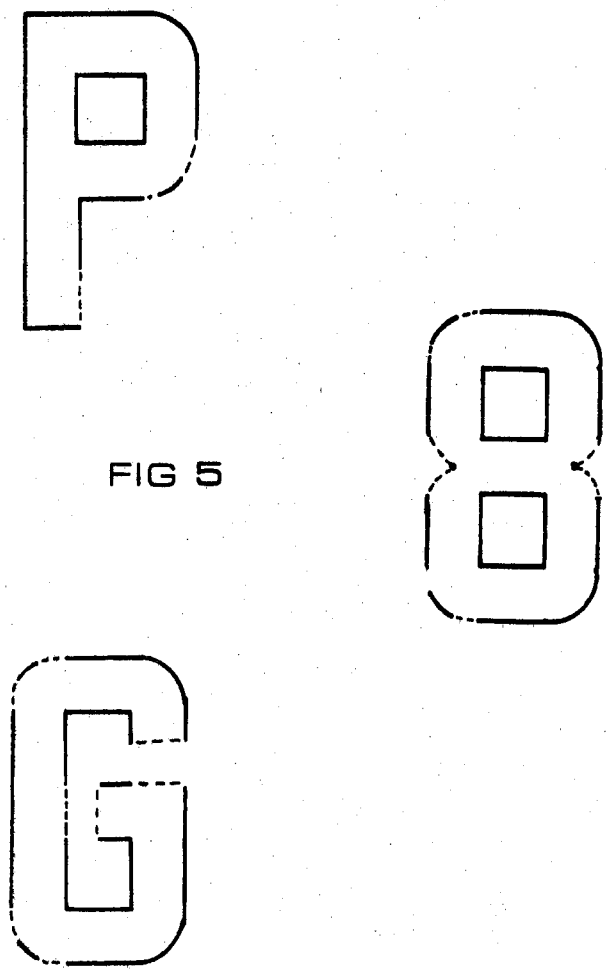

Preferred embodiments of the lettering stencil will now be described with reference to the accompanying drawings, wherein:

FIG. 1 shows a first embodiment of the lettering stencil, and,

FIG. 1*a* shows a letter of the alphabet formed using the lettering stencil of FIG. 1 and, FIG. 2 shows a second embodiment of the lettering stencil, and, FIG. 3 shows a third embodiment of the lettering stencil, and, FIG. 3*a* shows a different view of the third embodiment of the lettering stencil, and, FIG. 4 shows a fourth embodiment of the lettering stencil, and, FIG. 5 shows letters formed using the lettering stencil.

With particular reference to FIG. 1 it can be seen that the first embodiment of the lettering stencil comprises a flat rectangular sheet or plage generally indicated at 1, which may be formed of metal, plastic or any suitable material and which is provided with two cutout sections 3 and 4 preferably but not necessarily of a square shape, preferably but not necessarily located centrally in said rectangular plate as shown. In the preferred embodiment the squares 3 and 4 are located so that three sides of each square are spaced equidistant from the sides at the rectangular plate 1. The rectangular plate 1 is provided with twelve reference notches 5 formed in its outside perimeter, two reference notches 5 in each of the shorter sides and four reference notches 5 in each of the longer sides. These reference notches 5 are preferably but not necessarily substantially equidistantly spaced around the outside perimeter of the rectangular plate 1. The rectangular plate 1 is also provided with four further reference notches 5 formed in those sides of squares 3 and 4 which are parallel to the shorter sides 8 and 9 of the rectangular plate. These further reference notches 5 are preferably located midway along said sides of the squares 3 and 4. Scribe lines 6 and 7 are formed on at least one, but preferably both surfaces of the rectangular plate 1, these scribe lines 6 and 7 being preferably parallel to the shorter sides 8 and 9 of the rectangular plate 1 and preferably but not necessarily each bisecting one of the square shaped cutout sections 3 and 4. The stencil may be used in the above form but preferably the first embodiment of the lettering stencil is also provided with a corner forming piece 10, which is a substantially square shaped flat plate having rounded corners, the radi of each corner preferably but not necessarily being of different lengths.

The typical use of this first embodiment lettering stencil will now be described, by way of example only, to form the letter "S" shown in FIG. 1*a*. The rectangular plate 1 is placed onto the surface on which it is desired to form a letter, and a writing instrument is used to trace lines $\overline{ab}$, $\overline{cd}$, $\overline{ef}$, $\overline{fg}$, $\overline{gl}$, $\overline{ij}$, $\overline{kl}$, $\overline{mn}$, $\overline{op}$, $\overline{qr}$, $\overline{st}$, $\overline{tu}$, $\overline{uv}$, $\overline{vw}$, as shown in heavy lines on FIG. 1*a*, using the reference notches 5 as guides to line length. The rectangular plate 1 may then be removed to leave a substantial image of the letter "S" as shown in FIG. 1*a*. The corner forming piece 10 may then be used to form rounded corners on the letter image as required, the radius of these corners being chosen from those on square plate 10 as desired. In this manner, any letter of alphabet, numeral, or the like may be formed, either in temporary outline form for later ink or paint application, or in permanent form initially.

FIG. 2 shows a second embodiment of the lettering stencil, this second embodiment comprising a flat substantially rectangular plate similar to the rectangular plate of the first embodiment hereinbefore described, but having two outsdie corners rounded as shown at 20 and being provided with curved slots 21 and quide holes 22 in the midsection of the rectangular plate as shown. This second embodiment of the lettering stencil may be used in a similar manner to that described hereinbefore for the first embodiment of the lettering stencil, but curved portions of the letter may be traced directly using the rounded corners 20 and curved slots 21 which in conjunction with guide holes 22 provide a centering reference for use when constructing the midsection of letter B, number 8 or similar letters.

FIG. 3 shows a third embodiment of the lettering stencil, comprising a flat rectangular plate similar to that of the second embodiment of the lettering stencil hereinbefore described, but having all its outside corners rounded as shown at 30 and being provided with a hole 31 in its midsection, the centre of this hole 31, coinciding with the centroid of the rectangular plate. The third embodiment of the lettering stencil is also provided with a flat T shaped plate generally indicated at 35 having the length of its cross arm 36 equal to the length of the longer sides of the rectangular plate, and being provided in its base section 37 with a hole 38, the positioning of this hole 38 being such that when the T shaped section 35 is super-imposed onto the rectangular plate as shown in FIG. 3*a* such that the hole 31 in the rectangular plate will register with the hole 38 in the T shaped section 35, then the top edge 39 of the T cross-arm will coincide with portions of the shorter sides of the rectangular plate. The third embodiment lettering stencil may be used in a similar manner to that hereinbefore described for the previous embodiments, with the T shaped section being used to provide square corners as required.

FIG. 4 shows a fourth embodiment of the lettering stencil, comprising a flat rectangular plate similar to the rectangular plate of the third embodiment but being provided with flat substantially guadrant sections 51 at each of its corners, each said quadrant section 51 being pivotably mounted such that it may be pivoted to a first position wherein its curved edge will coincide with a rounded corner of the rectangular plate, or to a second position wherein its square corner will extend beyond the rounded corner of the rectangular plate. The fourth embodiment of the lettering stencil may be used in a similar manner to the manner thereinbefore described for the previous embodiments of the lettering stencil, the pivotable corner sections being utilised to form rounded or square corner. It is envisaged within the scope of the invention that the pivotably mounted corner pieces may be of any desired shape so as to enable the corners of letters or numerals to be formed with the desired shape.

I claim:

1. A stencil comprising a substantially rectangular plate and a corner forming piece wherein the substantially rectangular plate consists of two regions of substantially equal surface area, each of said regions having an aperture located substantially centrally within the region, the substantially rectangular plate being provided with indication means proximal to its perimeter, wherein, at least one corner formed by the intersection of any two sides of the perimeter of the plate is a radiused corner and wherein the corner forming piece may be pivotally mounted on the rectangular plate and has at least one right angle corner formed on its perimeter such that one of the said radiused corner(s) of the said plate may have one of the said right angle corner(s) of the corner forming piece substantially superimposed thereover so as to form a right angle corner thereon.

2. A stencil as claimed in claim 1 wherein said corner forming piece has a plurality of substantially right angle corners formed on its perimeter so that any one of the said at least one radiused corner(s) of the said substantially rectangular plate may have at least one of the right angle corners of the corner forming piece substantially superimposed thereover so as to form a right angle corner thereon.

3. A stencil as claimed in claim 1 wherein the at least one corner formed by the intersection of any two sides of the perimeter of the said plate is radiused corner, and wherein the corner forming piece comprises a plate having a right angle corner in its perimeter, said corner forming piece being pivotably mounted adjacent the said radiused corner such that said corner forming piece may be pivoted to a first position wherein no portion of said corner forming piece extends beyond the perimeter of said plate, and to a second position wherein the said right angle corner of said corner forming piece is substantially superimposed over said radiused corner of said plate so as to form a right angle corner thereon.

4. The stencil as claimed in any one of the preceding claims wherein said indication means comprises a series of notches spaced about the said perimeter.

5. The stencil as claimed in any one of claims 1-2 wherein said apertures are provided with indication means proximal to the perimeter thereof.

6. The stencil as claimed in any one of claims 1-2 wherein any one or more of said plates or said corner forming means is provided with a curved slot therethrough, positioned so as to assist in forming a curved portion of a letter or numeral.

7. The stencil as claimed in any one of claim 1-2 wherein any one or more of said plates or said corner forming means is provided with a hole therethrough to assist in forming a portion of a letter or numeral.

8. A stencil comprising a substantially rectangular plate and a plurality of corner forming pieces wherein the substantially rectangular plate consists of two regions of substantially equal surface area, each of said regions having an aperture located substantially centrally within the region, the substantially rectangular plate being provided with indication means proximal to its perimeter wherein the corners formed by the intersection of the sides of the perimeter of the said plate are radiused corners, and wherein each corner forming piece comprises a plate having a right angle corner in its perimeter, one said corner forming piece being pivotably mounted adjacent each said radiused corner such that each said corner forming piece may be pivoted to a first position wherein no portion of the corner forming piece extends beyond the perimeter of said plate, and to a second position wherein the said right angle corner of said corner forming piece is substantially superimposed over said radiused corner of said plate so as to form a right angle corner thereon.

* * * * *